US006520247B2

(12) United States Patent
Hultmark

(10) Patent No.: US 6,520,247 B2
(45) Date of Patent: Feb. 18, 2003

(54) AIRCONDITIONING DEVICE

(75) Inventor: Göran Hultmark, Västra Frölunda (SE)

(73) Assignee: Teknoterm Climate AB, Askim (SE)

( * ) Notice: Subject to any disclaimer, the term of this patent is extended or adjusted under 35 U.S.C. 154(b) by 66 days.

(21) Appl. No.: 09/846,947

(22) Filed: May 1, 2001

(65) Prior Publication Data

US 2002/0007934 A1 Jan. 24, 2002

Related U.S. Application Data

(63) Continuation of application No. PCT/SE99/02010, filed on Nov. 5, 1999.

(30) Foreign Application Priority Data

Nov. 5, 1998 (SE) ..... 9803823

(51) Int. Cl.[7] ..... F24F 1/01

(52) U.S. Cl. ..... 165/56; 165/53; 165/123; 454/233

(58) Field of Search ..... 165/53, 56, 57, 165/123; 454/233

(56) References Cited

U.S. PATENT DOCUMENTS 3,032,323 A * 5/1962 Church ..... 165/123
3,833,057 A * 9/1974 Doherty ..... 165/123

FOREIGN PATENT DOCUMENTS

DE 3321612 A1 12/1984
DE 29609754 U1 2/1997
DE 19809195 A1 9/1998
DE 19726522 A1 12/1998
EP 0967443 A2 12/1999
EP 0967444 A2 12/1999
FR 1.347.152 9/1962
FR 1.545.745 A * 11/1968 ..... 165/123
GB 2271175 A 4/1994
GB 2322934 A 9/1998
WO WO94/24491 10/1994
WO WO 98/09115 3/1998

* cited by examiner

*Primary Examiner*—Allen Flanigan
(74) *Attorney, Agent, or Firm*—Samuels, Gauthier & Stevens, LLP

(57) ABSTRACT

An air-conditioning device especially for ceiling placement with low build-in height and comprising at least one preferably vertically oriented heat exchanger, with substantially horizontal percolation of the room air and at least one ventilation channel for fresh air provided substantially parallel to and within a small distance from the heat exchanger, at its outlet side, a downwards open air chamber provided between the ventilation channel and the heat exchanger, and air nozzles provided in the channel side wall of the ventilation channel facing the air chamber, which are directed towards the outlet of the air chamber. The ventilation channel is provided with a preferably convex channel wall which diametrically extends substantially from the upper corner of the ventilation channel to the lower corner of the ventilation channel. The heat exchanger and the ventilation channel are arranged with a downwards, diverging open air space. Along the ventilation channel are provided at least a row with, in the diverging air space upper portion, debauching nozzles for ventilating air. The channel wall is formed and directed so that the streams of ventilating air through the nozzles is provided to, according to the coanda effect, temporary adhere along the whole channel wall before the streams continue horizontally along the ceiling.

9 Claims, 4 Drawing Sheets

AIRCONDITIONING DEVICE

This is a Continuation of Application No. PCT/SE99/02010, filed Nov. 5, 1999.

The present invention refers to an airconditioning device especially for ceiling placement with low build-in height and comprising at least one, preferably vertically oriented beat exchanger, with substantially horizontal percolation of the room air and at least one ventilation channel for fresh air provided substantially parallel with and within a small distance from the heat exchanger, at its outlet side, a downwards open air chamber provided between the ventilation channel and the heat exchanger, and air nozzles provided in the channel side wall of the ventilation channel facing the air chamber, which are directed towards the outlet of the air chamber.

BACKGROUND OF THE INVENTION AND THE PROBLEM

Airconditioning device for ceiling placement are known, especially for cooling and ventilating room air, see for example GB 2 271 175 A and WO 94/24491, where an addition of primary air, ie ventilating air, to the room air cooled by the cooling element contributes to the circulation through the cooling element. These devices are constructed and work in such a way, that the warm room air, by means of self-circulation flows vertically upwards and into the devices, where the warm air is cooled by the cooling element and would, as a consequence of its density, sink down into the room if the primary air would not be directed in such a way that the air flows out along the underside of the ceiling. In this way a self-circulation of the room air, a regulation of the air temperature and a relatively draught free environment are obtained.

Disadvantages with these conventional airconditioning devices are:

- their large build-in height, because of the fact that the cooling element is usually placed horizontally and the percolation air must be brought to the upper side of the cooling element;
- the disturbing sound caused by outlet of primary air; and
- that the cooled air only to a limited extent follows the underside of the ceiling, because of the abrupt change in direction of the air flow.

THE OBJECT OF THE PRESENT INVENTION AND THE SOLUTION TO THE PROBLEM

The object of the present invention is to provide an airconditioning device, which:

- has a low build-in height, whereby the height of the room can be decreased and thereby the building costs;
- is placed tight to the ceiling, which facilitates mounting from below and prevents apperance of recesses that are difficult to find, where dust and dirt can be collected;
- has a simple construction, and therefore has low manufacturing costs;
- has a very low outlet sound;
- has good opportunities for the cooled air to follow the underside of the ceiling along a longer distance and thus reduces the risks for down draft;
- is built by modules and can be assembled in many different combinations for different purposes and local conditions;
- is able to integrate with light fittings and optional addition of heat.

These objects have been solved through the characteristics stated in the claims.

DESCRIPTION OF THE DRAWINGS

In the following the invention will be further described by a number of examples with reference to accompanying drawings.

DESCRIPTION OF EMBODIMENTS

Figure 1:
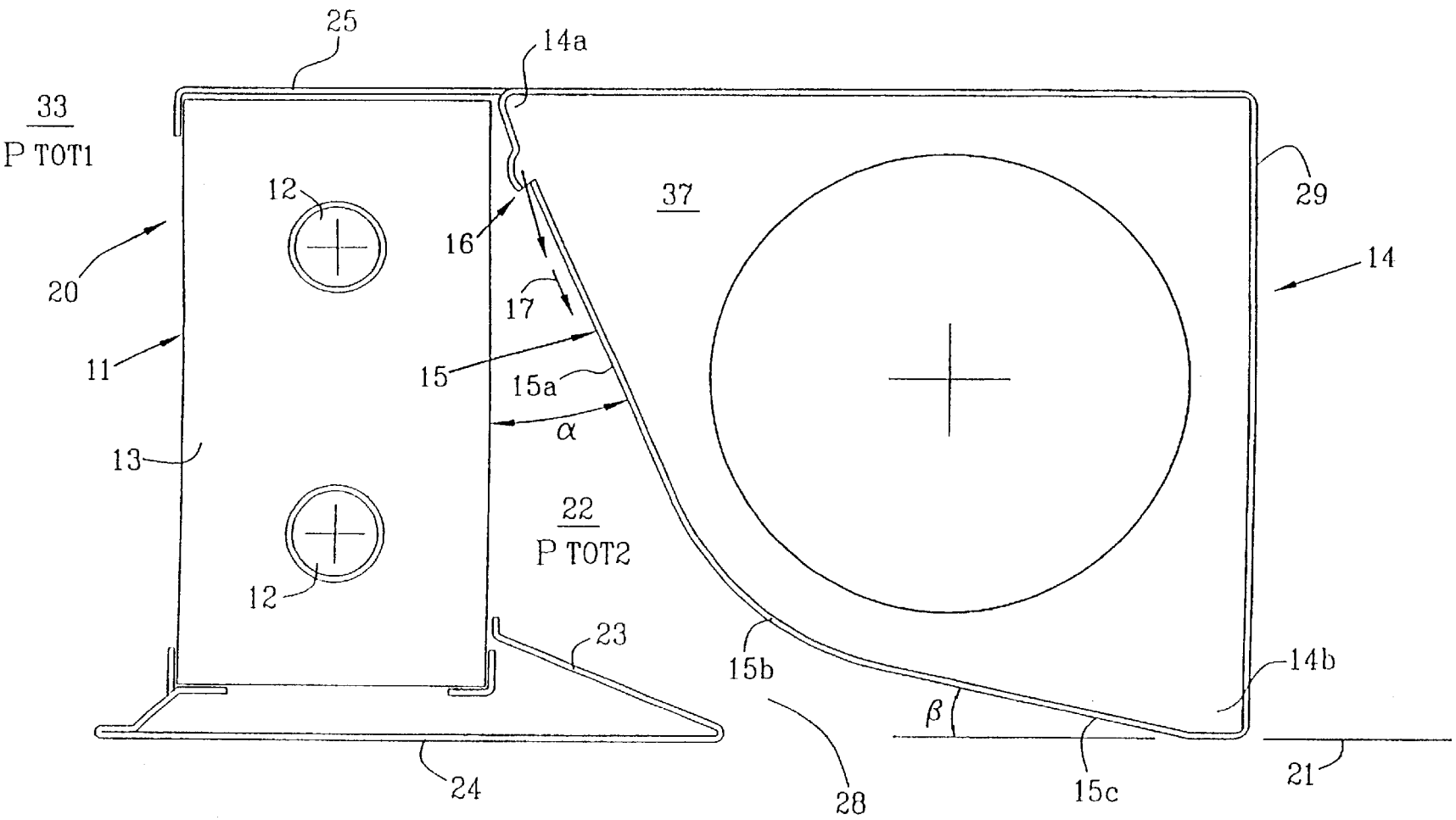
FIG. 1 shows a cross section of a basic model of a device according to the invention.

The basic model of the airconditioning device shown in FIG. 1 comprises a conventional, continuous heat exchanger 11, for example a cooling element, comprising cooling medium channels 12 and a large number of transverse cooling flanges 13 provided within some distance from one another. Parallel to the heat exchanger a ventilation channel 14 is provided for primary air, which is so designed that one of its channel walls 15, the one facing the heat exchanger 11, forms an acute angel $\alpha$ to the heat exchanger, which angle should not be less than 15°, at which one of the upper corners 14*a* of the ventilation channel 14 is situated in close connection to the upper end of the heat exchanger 11. At the upper, straight portion 15*a* of said channel wall at least one longitudinal row of air nozzles 16 are arranged, which are directed downwards, so that the outlet air stream 17 flows along the inclined channel wall 15. This changes into a bevelled portion 15*b* and continues as a plane, lower channel wall portion 15*c* in direction towards the lower corner 14*b* of the ventilation channel 14, which is diametrically situated opposite the corner 14*a*. The lower channel wall portion 15*c* forms an acute angel $\beta$ to the horizontal plane, before it changes into the corner 14*b* and the ceiling 21. It is of course possible to design the channel wall portion 15*b* of straight shorter parts, assembled to a curve instead of the convex, bevelled embodiment, but it is important that the change in direction is not greater than that the coanda effect is retained almost unchanged even at a considerable distance along the ceiling.

By the known coanda effect, the outflowing primary air from the air nozzles 16 will "adhere" to the channel wall portions 15*a*, 15*b* and 15*c* and follow these, wherein the self-circulating secondary air 20, ie the rising warm air, which passes through and is cooled down in the heat exchanger 11, is withdrawn by the primary air which is flowing downwards and is provided to flow along said wall portions and continues in a substantially horizontal direction along the underside of the ceiling 21 before it begins to sink downwards.

The free space 22 between the heat exchanger 11 and the ventilation channel 14 diverges in direction towards the lower portion of the heat exchanger, where a guide plate 23 is provided, which directs the air streams—mainly the secondary air—in direction towards the ceiling 21. The guide plate 23 is arranged in such a way that the passing air stream is only throttled to a limited extent and is preferably given substantially the same angle to the horizontal plane as the angle $\beta$ of the wall portion 15*c*. Preferably, the guide plate 23 is a part of a tray 24, which surrounds the bottom end portion of the heat exchanger and then works as a vessel for collecting optional condense water.

Preferably, the ventilation channel 14 and the heat exchanger 11 are integrated with each other, for example by a common top plate 25, wherein the outer side wall 29 of the ventilation channel 14 forms essentially 90° to the top plate 25, so that a substantially rectangular module is formed, which can be assembled in different combinations according to the FIGS. 5 to 11.

Figure 4:
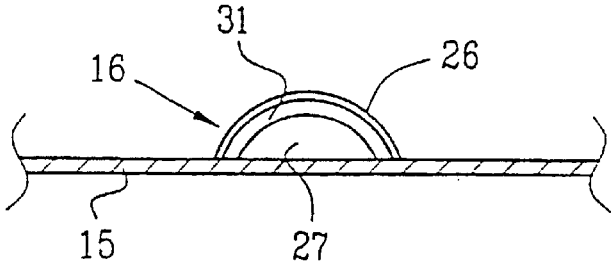
FIG. 4 shows a cross section along line IV—IV in FIG. 2.
Figure 2:
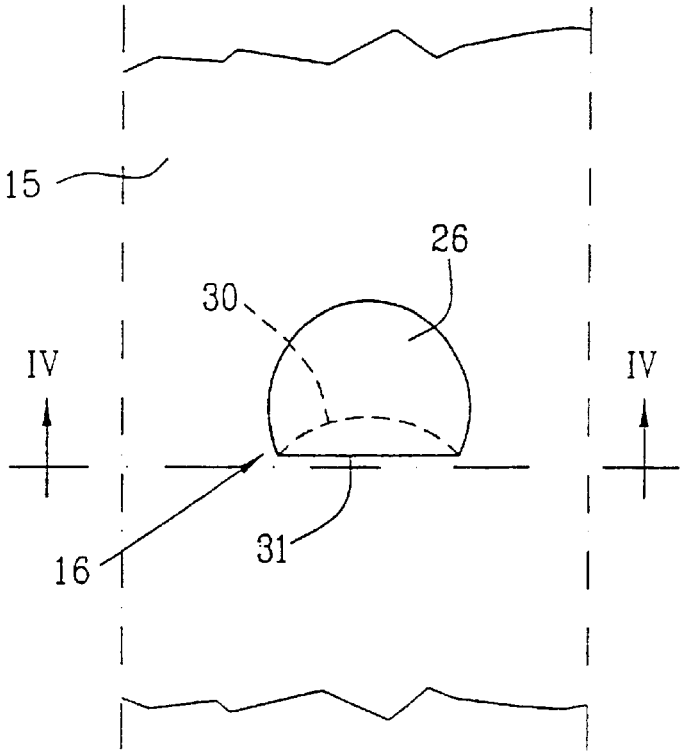
FIG. 2 shows a front view section in an enlarged scale of one of the air outlets.
Figure 3:
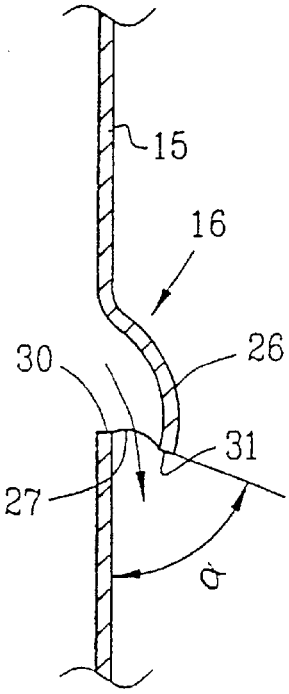
FIG. 3 shows a cross section along line III—III in FIG. 2.

The design of the air nozzles 16 is crucial in respect of the function of the air conditioning. As seen in FIG. 2 to 4 the nozzles are stamped out from the channel wall 15, preferably in the form of so called "eyelids" 26 with part spherical form, which bulge towards the air space 22, forming downwards directed aperture formed openings 27, which are oriented so that air streams 17 flowing out of the opening are directed substantially parallel to the channel wall 15. As seen from FIG. 3 a line drawn from the front edge 30 of the opening 27 to the front edge 31 of the eyelid 26 forms an angle γ to the channel wall 15, which means that the eyelid overlap the aperture 27 to some extent, so that the outgoing air stream receives an evident guiding in a direction along the channel wall 15 and the coanda effect appears. The choice of a partly spherical bulge 26, has the advantage that the air stream is not only guided straightly downwards through the aperture opening, but also obtains a component directed inclined to the channel wall.

The above described embodiment of the air nozzles 16 is based on a construction that is advantageous in respect of manufacturing technique, but the nozzles can of course have other forms and constructions, provided they fulfill the above mentioned demands.

To obtain an effective heat exchange—cooling—it is important that the Total Pressure $P_{TOT\ 1}$ and $P_{TOT\ 2}$—see FIG. 1—on both sides of the heat exchanger 11 is very small. This is obtained as the throttling in the outlet 28 from the space 22 is small and that the nozzles create said coanda-effect, whereby the primary air provides the secondary air with a motion composant, so that the way of the air stream out of the device is as short and open as possible. The cooling effect from the heat exchanger 11 increases with higher speed there through.

As the primary air has to go through a change of direction from vertical to horizontal direction without appreciably losing its adhesitivity and the air stream adhered along the channel wall 15 shall continuously be able to grow in the outlet direction and be transferred along the horizontal surface of the ceiling 21, each change of direction of the curved or straight passage 15*b* between the plane channel wall portions 15*a*, 15*c* should not exceed 20°.

Because of the high speed (several meters per second) of the primary air out of the air nozzles 16 a high dynamic pressure $P_{DYN\ 2}$ is obtained. If $P_{TOT\ 1}$ is about the same as $P_{TOT\ 2}$ and the speed at the inlet side of the heat exchanger is low, ie $P_{DYN\ 1}\approx 0$, the static pressure $P_{STAT\ 1}$ is higher than $P_{STAT\ 2}$ and the air is passing through the heat exchanger 11.

$$P_{TOT\ 1}\approx P_{TOT\ 2}\approx P_{STAT\ 1}+P_{DYN\ 1}\approx P_{STAT\ 2}+P_{DYN\ 2}$$

$$P_{STAT}-P_{STAT}\approx P_{DYN\ 2}$$

Note! The approximations:

$P_{TOT\ 1}\approx P_{TOT\ 2}$ (a small throttle in the outlet 28)

$P_{DYN\ 1}\approx 0$ (low speed at the inlet side of the heat exchanger)

To obtain as large amount of air as possible through the heat exchanger 11 the angle α should be sufficiently large so that the air stream 17 does not hit the heat exchanger. The angle α should therefore exceed 15°.

Greatest amount of secondary air and thereby greatest cooling effect is obtained if the air stream 17 sweeps near the heat exchanger. The angle a should therefore not exceed 45°.

With the above described dimensioning the amount of secondary air 20 is 5 times as large as the amount of primary air in the air streams 17.

If the air streams 17 sweep close to the heat exchanger a higher degree of turbulence at the laminae of the heat exchanger occurs, which increases the heat transfer and therefore the cooling effect in the heat exchanger.

The module assembling of the airconditioning device makes it possible, to obtain several different variations suitable for different existing demands with different combinations and amplifications.

Figure 5:
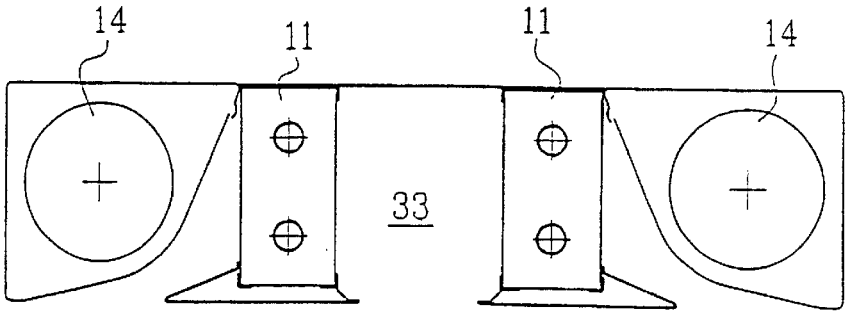
FIGS. 5–11 shows cross sections through different embodiments.

In the embodiment according to FIG. 5 two modules are arranged reverse to and within a distance from each other and with the heat exchangers facing each other, so that a common inlet chamber 33 is formed.

Figure 6:
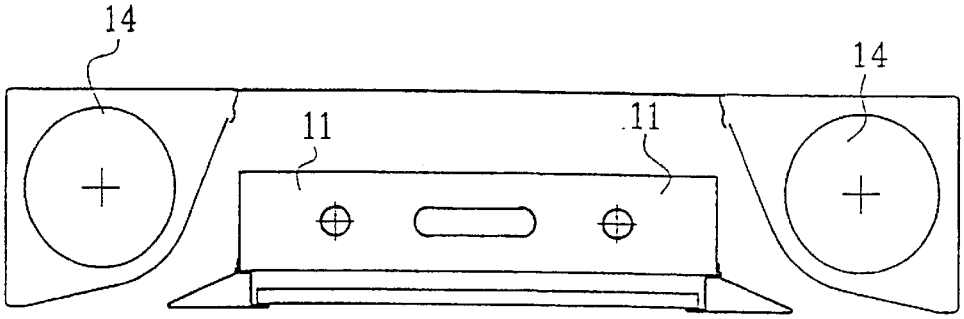

In FIG. 6 two heat exchangers 11 are connected end to end and placed horizontally—lying—within a distance from the top plate 25 and between two outer ventilation channels 14.

Figure 7:
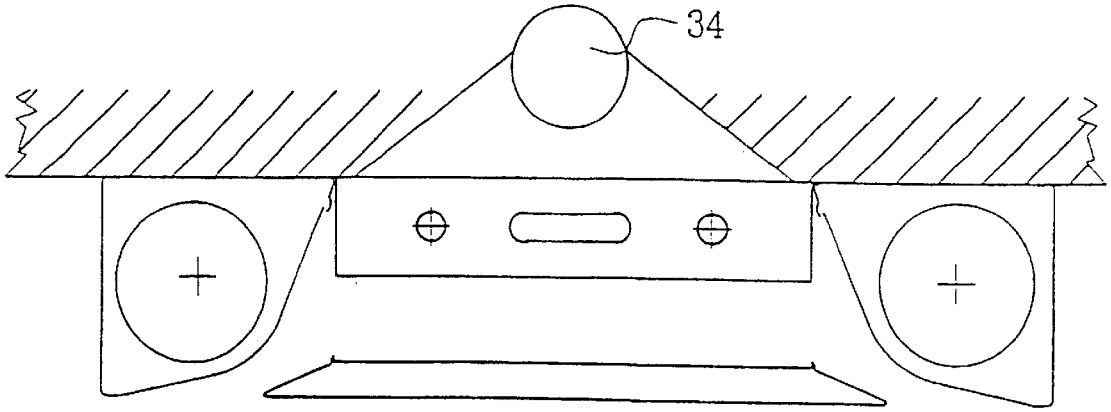

FIG. 7 shows an embodiment of the same type as in FIG. 6, but where a supply channel 34 is provided in the existing ceiling for ventilating air and the heat exchangers are arranged against the top plate 25.

Figure 8:
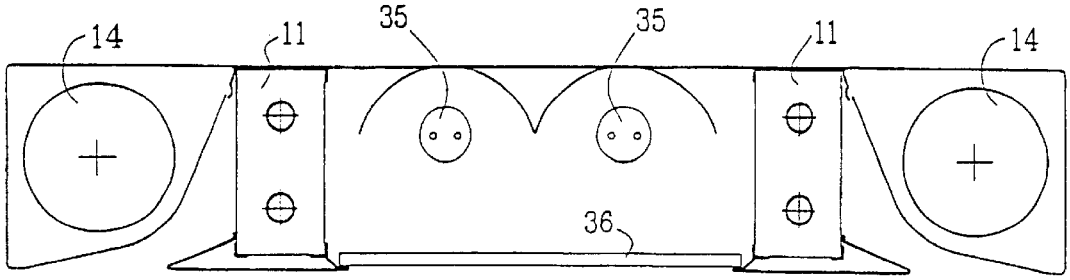
Figure 9:
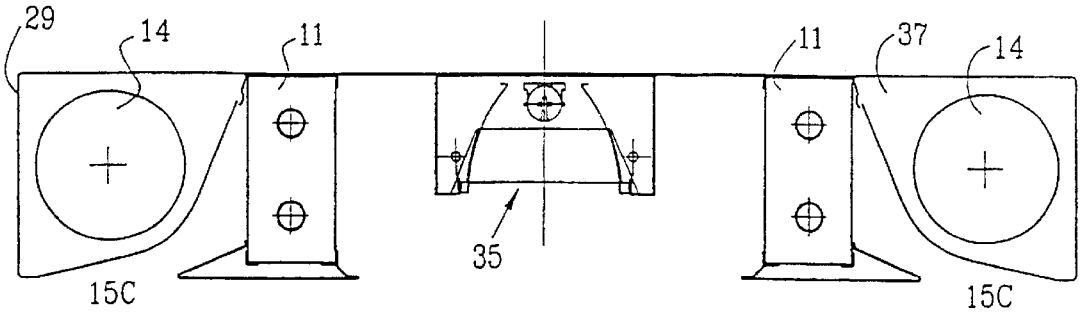

FIG. 8 and 9 shows two variations, where one or several light fittings 35 are provided in a larger interspace between two modules placed in the inlet chambers 33 and where the secondary air is supplied via optional louvres 36.

Figure 10:
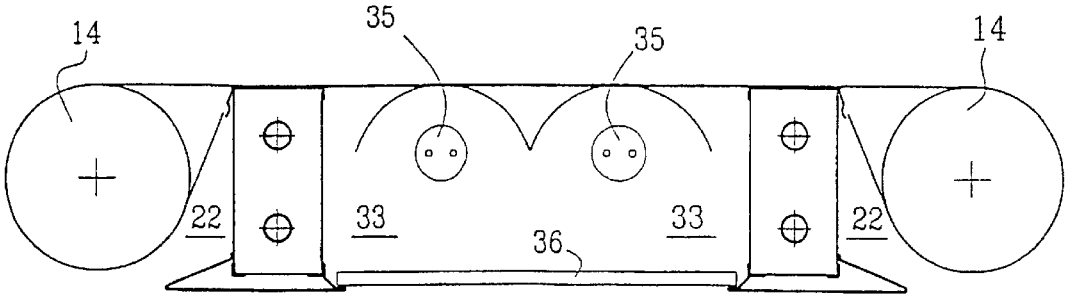

The embodiment showed in FIG. 10 distinguishes from the former in that the ventilation channels 14 lacks the channel wall portion 15*c* and the rear side wall 29. Instead the ventilation channel is circular, except for the distribution box 37 tapered towards the corner 14*a*.

Figure 11:
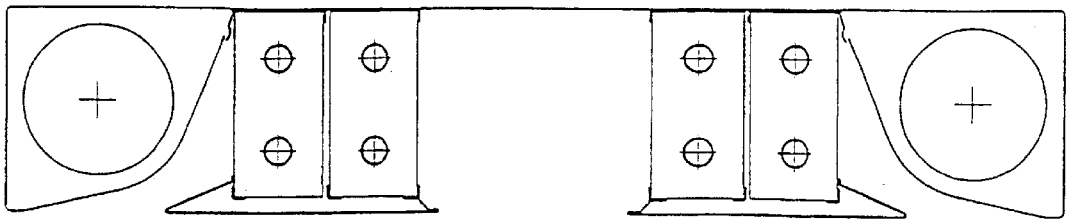

In FIG. 11 the heat exchangers 11 have been doubled which can be necessary in such cases where a larger cooling need exists or where cold as well as heat are needed at different times.

The device according to the invention can consist of one or several parts of a ceiling 21, ie the underside of the module is placed in the same level as the ceiling, but can also be used as a separate element.

LIST OF REFERENCE NUMERALS heat exchanger 11
cooling medium channels 12
cooling flanges 13
ventilation channel 14
upper corner 14*a*
lower corner 14*b*
channel wall 15
upper channel wall portion 15*a*
bevelled channel wall portion 15*b*
lower channel wall portion 15*c*
air nozzle 16
air stream 17
secondary air 20
ceiling 21
free space 22
guide plate 23
tray 24
top plate 25
bulge/eyelid 26
opening 27
outlet 28 outer side wall 29
opening front edge 30
eyelid front edge 31
side limitation 32
inlet side 33
supply channel 34
light fittings 35
louvre 36
distribution box 37

What is claimed is:

1. An air-conditioning device for ceiling placement with low build-in height and comprising:

at least one heat exchanger oriented vertically relative to a horizontal direction, at least one ventilation channel for fresh air provided substantially parallel to and within a small distance from the heat exchanger at its outlet side, a downwardly opening air chamber provided between the ventilation channel and the heat exchanger, and having an outlet;

air nozzles provided in the channel side wall of the ventilation channel facing the air chamber, which are directed towards the outlet of the air chamber, wherein said air chamber is provided with a cross section which widens in the direction towards the outlet and having the air nozzles, in the upper, thinner part of the air chamber, said channel side wall is designed to form a first wall part disposed at an acute angle ($\alpha$) with respect to the heat exchange; a smooth curved second wall disposed part, between the first wall part and a third wall part, forming a bottom of the ventilation channel, the air nozzles being designed such that the streams of the ventilating air through the air nozzles are directed towards-and along said first wall part to flow uninterrupted, according to the coanda effect, and temporarily adhere along the second and third wall parts which extend away from the heat exchanger.

2. A device according to claim 1, wherein the air nozzles are designed with bulges provided with openings which bulges extend from the channel wall in direction towards the heat exchanger, and that the front side of the bulge is arranged to overlap the front edge of the air nozzle.

3. A device according to claim 1, wherein the air nozzles are designed partly spherically with "eyelids" bulging from the channel wall, and that the eyelid comprises more than half of the part sphere.

4. A device according to claim 1, wherein the side of the ventilation channel facing away from the channel wall, is provided to form one of the side gables of the device, which is arranged across the top plate of the channel.

5. A device according to claim 1, wherein the third wall portion of the channel wall is provided to change into a slightly inclined portion relative to the horizontal plane.

6. A device according to claim 1, wherein a guide plate is provided near the lower end portion of the heat exchanger and arranged into the lower portion of the mixing chamber, which is designed to guide the secondary air from the heat exchanger towards the lower portion of the channel wall.

7. A device according to claim 6, wherein the guide plate is formed and provided to throttle only to a limited extent the air stream comprised of primary and secondary air.

8. A device according to claim 1, wherein the ventilation channel and the heat exchanger are connected to each other, forming an integrated module, wherein the top plate of the ventilation channel forms the connecting element between these.

9. A device according to claim 1, wherein the angle (a) between the first wall portion and the heat exchanger is between 15° and 45°.

* * * * *